United States Patent [19]

Mathy et al.

[11] Patent Number: 4,832,737

[45] Date of Patent: May 23, 1989

[54] HIGH TEMPERATURE-RESISTANT ALUMINUM ALLOY AND PROCESS FOR ITS PRODUCTION

[75] Inventors: Ignaz Mathy, Waldesch; Günther Scharf, Bonn, both of Fed. Rep. of Germany

[73] Assignee: Vereinigte Aluminium-Werke Aktiengesellschaft, Fed. Rep. of Germany

[21] Appl. No.: 908,554

[22] Filed: Sep. 18, 1986

[30] Foreign Application Priority Data

Sep. 18, 1985 [DE] Fed. Rep. of Germany ..... 3533233

[51] Int. Cl.[4] ..... C22C 21/12

[52] U.S. Cl. ..... 75/249; 148/416; 148/417; 148/418; 148/403

[58] Field of Search ..... 75/249; 148/416, 417, 148/418, 403

[56] References Cited

U.S. PATENT DOCUMENTS

| | | | |
|---|---|---|---|
| 2,963,780 | 12/1960 | Lyle, Jr. et al. | 75/249 |
| 2,966,731 | 1/1961 | Towner et al. | 75/249 |
| 3,004,331 | 10/1961 | Towner et al. | 75/249 |
| 3,637,441 | 1/1972 | Lyle, Jr. et al. | 75/249 |
| 3,754,905 | 8/1973 | Knoop | 75/249 |
| 4,021,271 | 5/1977 | Roberts . | |
| 4,347,076 | 8/1982 | Ray et al. | 75/249 |
| 4,464,199 | 8/1984 | Hildeman et al. . | |

FOREIGN PATENT DOCUMENTS

| | | | |
|---|---|---|---|
| 897921 | 7/1949 | Fed. Rep. of Germany . | |
| 3144445 | 8/1982 | German Democratic Rep. . | |
| 57-158360 | 9/1982 | Japan | 148/418 |
| 59-126761 | 7/1984 | Japan | 148/416 |
| 0137180 | 8/1984 | Japan . | |
| 60-125347 | 7/1985 | Japan | 75/249 |
| 2088409 | 11/1981 | United Kingdom . | |

*Primary Examiner*—Stephen J. Lechert, Jr.
*Assistant Examiner*—Eric Jorgensen
*Attorney, Agent, or Firm*—Darby & Darby

[57] ABSTRACT

A high temperature-resistant aluminum alloy is disclosed, comprising an aluminum matrix containing a dispersion mixture of reinforcing aluminum-iron particles with 2–16% nickel and/or cobalt, 1–6% copper and 1–3% manganese. The weight ratio of the copper to manganese is between about 2:1 and 1:1, and the intermetallic phases of the type AlCuMn, $Al_3Ni$ and/or $Al_9Co_2$ are present in spherical forms.

6 Claims, No Drawings

HIGH TEMPERATURE-RESISTANT ALUMINUM ALLOY AND PROCESS FOR ITS PRODUCTION

BACKGROUND OF THE INVENTION

The invention relates to a high temperature-resistant aluminum alloy consisting essentially of an aluminum matrix containing a dispersion mixture of reinforcing Al-Fe particles.

An aluminum alloy of the type to which the invention pertains is disclosed in German Patent No. 3,144,445. FIG. 2 of that patent discloses that the alloy referred to as Al 8Fe 2Mo has a room temperature strength after solidification of 390 $N/mm^2$ (where N represents Newtons; 10 ksi=68.9476 $N/mm^2$). To produce this alloy, it is necessary that the average particle size be less than 0.05 μm and that very rapid cold forming (greater than 105° C. per second) be used. Moreover, in practice, the working properties of the alloy, especially at high contents of refractory elements, leaves something to be desired.

In addition, a heat-resistant aluminum alloy, with 6–8% manganese, 0.5–2% iron, 0.03–0.5% zirconium and 2–5% copper, is disclosed in European Patent No. 01 37 180. To produce that alloy, molten metal is superheated at 150° C. above the melting point of the starting materials for the powder. The size of the pulverulent particles is less than 120 mesh (page 7, column 4). It has been found that alloys so produced do not have good machining properties or good ductility (i.e., the ability to deform without fracturing).

It is an object of the present invention to develop new aluminum alloys which can easily be produced from pulverulent particles of relatively large average particle size.

Another object of the present invention is to produce aluminum alloys which have good heat resistance, a high room temperature strength, improved corrosion behavior and higher fatigue strength.

A further object of the present invention is to provide a process for producing such aluminum alloys.

SUMMARY OF THE INVENTION

One aspect of the present invention is directed to a high temperature-resistant aluminum alloy consisting essentially of an aluminum matrix containing a dispersion mixture of reinforcing aluminum-iron particles, and, optionally, one or more of the refractory elements selected from the group consisting of titanium, chromium, tungsten, zirconium, niobium, molybdenum, cerium and vanadium, the total contents of said reinforcing particles being between about 20 and 40% by weight, wherein the alloy further contains: 2–16% nickel and/or cobalt; 1–6% copper; and 1–3% manganese, the weight ratio of copper to manganese being between about 2:1 and 1:1, and the intermetallic phases of the type AlCuMn, $Al_3Ni$ and/or $Al_g Co_2$ being present in spherical form.

Another aspect of the present invention is directed to a process for producing a high temperature-resistant aluminum alloy from an alloy melt, comprising heating the melt to a temperature of at least 300° C. above the melting temperature of the respective alloy, and converting said alloy at a cooling rate of $10^2$–$10^4$K per second into pulverulent particles, at least 50% of said particles being greater than 80 μm, and the powder having an average cell size of less than 1 μm.

DETAILED DESCRIPTION OF THE INVENTION

It is known that precipitation hardening occurs with AlCuMn alloys. This is disadvantageous upon reheating, since the $Al_2Cu(Mn)$ phases become coarser due to the dissolution of the subdispersions (Ostwald maturing) and the strength-increasing effect is lost.

Unexpectedly, it has been discovered that the addition of copper and manganese in amounts of more than 1% to aluminum alloys comprising an Al matrix and reinforcing Al-Fe particles leads to improved strength behavior at high and room temperatures. Preferably, copper is present in an amount of 1–6% by weight and manganese in an amount of 1–3%.

Experimental evaluation has shown that the heat resistance of the alloys developed is determined by the formation of fine, stable, intermetallic phases, similar in type to AlCuMn, $Al_3Fe$, $Al_3Ni$ and $Al_9Co_2$, and of their mixed phases. It is also possible to attain a high room-temperature strength of up to 600 $N/mm^2$ Very stable intermetallic phases, which are precipitated in fine form (with an average particle size of less than 1 μm) by the rapid solidification process, are formed by further alloying in at least one of the elements nickel and cobalt. These fine, stable, intermetallic phases of aluminum are distributed in the aluminum alloy in amounts ranging between 20 and 40% and have a positive effect on the corrosion behavior. Preferably, the nickel and/or cobalt is present in an amount between 2 and 16% by weight.

The process of the present invention is performed as follows. A melt, containing the desired dispersion mixture is heated to a temperature at least 300° C. above the melting temperature of the alloy, and converted at a cooling rate of $10^2$–$10^4$ K per second into pulverulent particles. In various experimental applications of this process, at least 50% of the particles were found to be greater than 80 μm in size, and the powder had an average cell size of less than 1 μm.

In order to manufacture an aluminum object, a block of pulverulent alloy particles is produced at room temperature, having a denseness of 70–80%. The block is heated to 350°–480° C. and reshaped at a pressing rate of 2–10 meters per minute. This may be done by conventional means.

In comparison to continuous casting as performed using ingot material (I/M), the aluminum-wrought alloys, according to the invention, are produced at average quenching rates of $10^2$–$10^4$ K/sec. The average quenching rates of the alloy from the melt are attained by gas atomization, melt spinning, production of particles with the centrifugal mold process, etc., which may be known in the art (*Metal Handbook*, pp. 6–48–6–52, H. E. Boyer and T. L. Gall, eds., American Society for Metals, Metals Park, Ohio, 1985). These rapidly solidifying particles can subsequently be processed by known powder metallurgical (P/M) processes into wrought products, such as extruded products, parts produced by explosion consolidation, etc. The atomization of the alloy leads to fine dendritic distances (cell sizes), and while the AlCuMn alloy produced by conventional continuous casting has a cell size of about 50 μm, the average cell size according to the present invention is about 0.5 μm.

Through superheating to at least 300° C. above the melting temperature and subsequent quenching at a rate of between $10^2$ and 1245$10^4$ K/sec, the solubility of aluminum in the alloying element is increased significantly (as is the alloy content of the normal aluminum-wrought alloys). Moreover, by alloying 0.4–2.0% of at least one of the elements selected from the group consisting of titanium, zirconium, and chromium into the aluminum alloy, it becomes possible to form very fine phases of less than 0.2 μm in size and in an amount of about 80%. Because of the low diffusion coefficient and the fine, stable, intermetallic phases of aluminum that are formed with these elements, the heat resistance can be increased significantly by the addition of 0.5–1.5% of at least one of the elements selected from the group consisting of tungsten, molybdenum, cerium, niobium and vanadium. The total content of reinforcing particles for the alloys of the present invention is between 20 and 40 weight %.

Transmission electron microscopic examination of the alloy shows spherical particles of intermetallic phases of the type Al-Cu-Mn, surrounded by phases of $Al_3Fe$, $Al_3Ni$ and $Al_9Co_2$ and their mixed phases. This structure of fine, stable, intermetallic phases of aluminum has an effect on the working properties of the aluminum alloys.

The spherical particles are formed only when the ratio of copper to manganese falls in the range of 2:1 to 1:1.Experiments have shown that, at other weight ratios, either the strength or the machining properties diminish. In order to be able to retain this spherical structure unchanged during further processing operations, it is necessary to adjust the preheating temperatures to 350°–480° C. and the pressing rate to 2–10 m/minute. In contrast to previously prevailing teachings, it has proven to be advantageous for the pulverulent particles to have an average particle size in excess of 80 μm and preferably between 100–200 μm, if the consolidation before the transformation is to lead to a minimum denseness of 70–85%. In spite of the coarse powder fractions, high extrusion rates of 5–10 m/minute are attained. This is possible because powder particles of 160 μm of the alloy still have a very fine microstructure (cell size). During the transformation, very fine, roundish particles are formed from the microstructure by heterogeneous nucleation and shaping by the transformation process. These fine, roundish particles permit the alloys to be extruded at a high rate. The high pressing rate ensures that the manufacturing process is economic, although, of course, the transformation forces for the P/M (powder metallurgical) alloys increase due to the high alloy contents.

The special alloy contents also ensure extrusion temperatures of up to 500° C., which do not greatly impair the mechanical properties and which are higher than those described for comparable, metastable, supersaturated P/M alloys as described in U.S. Pat. No. 4,464,199.

Moreover, the very fine homogeneous structure of roundish particles of the alloy ensures that there is no pick up (chatter marks due to local fusing). The extruded profiles have particularly good, smooth surfaces, which are almost without any defect and can be anodized flawlessly.

The fatigue strength of the heat-resistant alloys of the present invention is better than 250 N/mm$^2$ (10 ksi=68.9476 N/mm$^2$). This is not only better than that of conventional aluminum alloys with particularly good fatigue strengths, but also better than that of comparable, heat-resistant aluminum P/M alloys. The fatigue strength is high at room temperature as well as at 150° C.

Furthermore, the particularly high elastic modulus (i.e., the ratio of stress to corresponding strain) is especially characteristic of these heat-resistant aluminum P/M alloys. The elastic modulus is 85–100 G Pa, as compared to the elastic modulus of 72 G Pa of the conventional, heat-resistant aluminum alloy, AA 2618. These properties make the present invention particularly well suited for applications where improved high-temperature strength are required, such as in turbine blades, fanwheel blowers, cylinder inserts, connecting rods, etc.

The invention is explained in greater detail below by means of several examples, which are meant to illustrate the invention without limiting its scope.

The use of the process of the present invention is illustrated as follows: The alloy Al 2Cu 1.5Mn 4Fe 4Ni (as in Table 5 below) is converted in an atomizer into pervulent particles as described above. The powder is cold-compacted into blocks. The block is attained by atomization in the suspended centrifugal mold process. These cold-compacted blocks (with a denseness of 80%) are subsequently hot-compacted at 380° C. The hot-compacted blocks are reshaped at a pressing rate of 5 meters per minute at 420° C. into flat sections.

The alloy Al 3Cu 1.5Mn 4Fe 4Ni 0.5Ti (as in Table 6 below) is produced using the same working cycle as described above except that the hot-compacting occurs at 350° C., and the subsequent extrusion (at the same rate) at 440° C.

A conventional, heat-resistant wrought aluminum alloy, produced by continuous casting, contains 2.7% copper, 0.2% manganese and 1.2% magnesium. The mechanical properties, attainable after precipitation hardening, are summarized in Table 1

TABLE 1

High-temperature tensile strengths ($R_m$ in N/mm$^2$) of the alloy AA 2618 T6 I/M (ingot material) according to the "HandBuch der Luftfahrt" (Handbook of Aeronautics), part 1, volume 2, Beuth, Berlin.)

| Heating Time | 150° C. | 200° C. | 250° C. | 300° C. |
|---|---|---|---|---|
| 100 h | 420 | 285 | 155 | 75 |
| 1,000 h | 395 | 265 | 120 | 62 |
| 10,000 h | 375 | 240 | 110 | 57 |

In Table 2, two alloys, Al 6Fe and Al 8Fe, produced by the powder metallurgical process with rapid cooling at about $10^4$ K/sec are compared. The processing temperature was 480° C. The size of the particles was about 0.3 μm. The structure of the intermetallic phases was more lamellar and platelike.

TABLE 2

Room temperature strengths of binary aluminum P/M alloys (produced from gas-atomized powders, less than 160 μm).

| | $R_{p0,2}$* N/mm$^2$ | $R_m$** N/mm$^2$ |
|---|---|---|
| Al6Fe | 180 | 265 |
| Al8Fe | 220 | 300 |

*$R_{p0,2}$ = Yield strength, i.e., the lowest stress at which permanent deformation occurs.

**$R_m$ = Tensile strength, i.e., the maximum stress that the sample can withstand before failure.

It is an important result of the present invention that alloying of copper and manganese into aluminum alloys with iron, nickel, cobalt, chromium, molybdenum, vanadium, cerium etc. (which form the very stable intermetallic phases) leads to very good room-temperature strengths. Moreover, the high-temperature strength does not decrease, or it decreases by an amount that is barely detectable relative to the high-temperature strengths of alloys containing no copper and manganese (see Table 3). The high-temperature strengths at 300° C. after a 200-hour pretreatment at 300° C., which are approximately the same, confirm that there is no Oswald maturing of the Al-Cu-Mn phases.

TABLE 3

Room-temperature and high-temperature strengths* of the P/M alloys, Al8Fe and Al3Cu1.5Mn8Fe.

| | RT | 150° C. | 200° C. | 250° C. | 300° C. |
|---|---|---|---|---|---|
| Al8Fe | | | | | |
| $R_m$ N/mm$^2$ | 300 | 240 | 200 | 160 | 140 |
| $R_{p0,2}$ N/mm$^2$ | 220 | 180 | 160 | 135 | 120 |
| Al3Cu1.5Mn8Fe | | | | | |
| $R_m$ N/mm$^2$ | 430 | 300 | 230 | 180 | 145 |
| $R_{p0,2}$ N/mm$^2$ | 350 | 240 | 200 | 155 | 120 |

*High-temperature strength after a 200-hour high-temperature pretreatment at the testing temperature.

In addition, it was confirmed that good room-temperature strengths and good high-temperature strengths are attainable only when both alloying elements, copper and manganese, are alloyed in (see Table 4). If only manganese is alloyed in with the Al 4Fe 4Ni alloy, the resulting alloy does not have the desired room-temperature strength (see Table 4). Admittedly, alloying copper alone into Al 4Fe 4Ni leads to relatively good room-temperature strengths. However, the heat resistance of this alloy at higher temperatures is inferior to that of alloys containing copper and manganese (see Table 4). If the Al 4Fe 4Ni alloy now contains copper and manganese, a good room-temperature strength and a good high-temperature strength is achieved once again (see Table 4).

An aging treatment between 20° C. and 220° C. gave no indications that the strength is affected by thermal aging. The AlCuMn precipitation phases, which can be found by transmissions electron microscopy, must arise during the preparation of the powder and/or during the powder metallurgical processing. The precipitation kinetics of these stable phases apparently are affected by the high contents of reinforcing particles (iron, nickel, etc.).

The corrosion behavior of the alloy was evaluated by means of the following test. Stress-corrosion cracking was tested in the critical transverse direction (LT) under a constant stress in 2% sodium chloride +0.5% sodium chromate at a pH of 3. The conventional heat-resistant I/M aluminum alloy, AA 2618, was tested for comparison (see Table 5). The alloys showed good general corrosion behavior and were also particularly resistant to corrosion under stress, that is, to stress-corrosion cracking.

TABLE 5

Stress-corrosion cracking behavior in the transverse direction (LT) Solution: 2% sodium chloride + 0.5% sodium chromate at a pH of 3.*

| | Stress | Durability |
|---|---|---|
| AA 2618 I/M | 90% $R_{p0,2}$ | 96.64 hours |
| AA 2618 I/M | 90% $R_{p0,2}$ | 74.89 hours |
| AA 2618 I/M | 90% $R_{p0,2}$ | 75.20 hours |
| Al2Cu1.5Mn4Fe4Ni P/M | 90% $R_{p0,2}$ | 1000 hours; NOT BROKEN |
| Al2Cu1.5Mn4Fe4Ni P/M | 90% $R_{p0,2}$ | 1000 hours; NOT BROKEN |
| Al2Cu1.5Mn4Fe4Ni P/M | 90% $R_{p0,2}$ | 1000 hours; NOT BROKEN |

*Test after LN 6566, Luftfahrt Norm: German Air Force Standard, for SCC

It is seen that the AA 2618 I/M is not resistant to stress-corrosion cracking, while the Al 2Cu 1.5Mn 4Fe 4Ni P/M alloy is.

An improvement in the heat resistance of the alloys described is achieved when the alloy contains 0.5–1.5% magnesium. The addition of magnesium does not lead to an improvement by precipitation curing, since an aging treatment at temperatures between 20° C. and 220° C. does not lead to an increase in strength; in other words, the strength is independent of the aging conditions. The addition of magnesium leads to an improvement in the mechanical properties of the aluminum P/M alloy because of the formation of fine magnesium oxide in the P/M wrought products. This can have a strength-increasing effect (like that of intermetallic phases) and a dimunition in defects (depressions) in the quenched alloys. The proportion of magnesium phases is less than 0.5% by volume. The addition of 0.55% magnesium to the alloy Al 3Cu 1.5Mn 4Fe 4Ni 0.5Ti increases the high-temperature tensile stength (see Table 6). The high-temperature tensile strengths of Table 6 were measured after 5,000 hours of high temperature aging. These results once again confirm the thermal stability of the alloy.

TABLE 4

Room-temperature and high-temperature strengths* of the Al4Fe4Ni alloy with (a) copper, (b) manganese and (c) copper plus manganese.

| | RT | 150° C. | 200° C. | 250° C. | 275° C. | 300° C. | 350° C. |
|---|---|---|---|---|---|---|---|
| (a) Al4Fe4Ni + 2Cu | | | | | | | |
| $R_m$ N/mm$^2$ | 430 | —** | 210 | —** | 140 | —** | 82 |
| $R_{p0,2}$ N/mm$^2$ | 340 | —** | 200 | —** | 135 | —** | 75 |
| (b) Al4Fe4Ni + 1Mn | | | | | | | |
| $R_m$ N/mm$^2$ | 325 | 250 | 210 | 175 | —** | 140 | —** |
| $R_{p0,2}$ N/mm$^2$ | 230 | 125 | 160 | 140 | —** | 120 | —** |
| (c) Al2Cu1.5Mn4Fe4Ni | | | | | | | |
| $R_m$ N/mm$^2$ | 480 | 300 | 230 | 185 | —** | 140 | —** |
| $R_{p0,2}$ N/mm$^2$ | 370 | 260 | 200 | 165 | —** | 125 | —** |

*High-temperature strength after a 200-hour high-temperature pretreatment at the testing temperature.
**Not done.

TABLE 6

Room-temperature and high-temperature strength* of the aluminum P/M alloy, Al3Cu1.5Mn4Fe4Ni0.5Ti, with and without 0.55% magnesium.

| | | | RT | 150° C. | 200° C. | 250° C. | 300° C. |
|---|---|---|---|---|---|---|---|
| Without | $R_m$ | $N/mm^2$ | 480 | 350 | 280 | 220 | 175 |
| Addition | $R_{p0,2}$ | $N/mm^2$ | 380 | 280 | 250 | 200 | 145 |
| +0.55% Mg | $R_m$ | $N/mm^2$ | 520 | 410 | 360 | 240 | 190 |
| | $R_{p0,2}$ | $N/mm^2$ | 400 | 370 | 340 | 225 | 160 |

*High-temperature tensile strength after 5,000 hours of high-temperature pretreatment at the testing temperature.

The invention has been described above by reference to preferred embodiments. It is understood that many additions, deletions and modifications will be apparent to one of oridinary skill in the art in light of the present description without departing from the scope of the invention, as claimed below.

What is claimed is:

1. A high temperature-resistant aluminum alloy comprising an aluminum matrix containing a dispersed mixture of reinforcing aluminum-iron particles with 2'16% nickel and/or cobalt, 1–6% copper, and 1–3% manganese, the weight ratio of copper to manganese being between about 2:1 and 1:1, wherein intermetallic phases of AlCuMn, $Al_3Ni$ and/or $Al_9Co_2$ are present in spherical form.

2. A high temperature-resistant aluminum alloy according to claim 1, wherein said reinforcing particles further include at least one refractory element selected from the group consisting of titanium, zirconium, niobium, molybdenum, tungsten, chromium and vanadium, the total amount of the reinforcing particles being between about 20 and 40% by weight.

3. A high temperature-resistant aluminum alloy according to claim 2, wherein the reinforcing particles have an average particle size of between 0.2 and 1 μm.

4. A high temperature-resistant aluminum alloy according to claim 3, wherein said dispersion mixture contains a combined amount of 0.4–2.0 weight percent of at least one substance selected from the group consisting of chromium, titanium and zirconium, at least 80% of said substance being in the form of phases less than 0.2 μm in size.

5. A high temperature-resistant aluminum alloy according to claim 4, wherein a combined amount of 0.5–1.5 weight percent of tungsten, cerium, molybdenum, niobium and/or vanadium are present predominantly at the phase boundaries of the intermetallic compounds.

6. A high temperature resistant aluminum alloy according to claim 5, wherein 0.5–1.5% magnesium is contained in the aluminum alloy and the proportion of magnesium phases is less than 0.5% by volume.

* * * * *